US009031477B2

(12) United States Patent
Ishii

(10) Patent No.: US 9,031,477 B2
(45) Date of Patent: May 12, 2015

(54) TONER CASE INCLUDING CONVEYING MEMBER ATTACHED TO CASE BODY AND IMAGE FORMING APPARATUS INCLUDING TONER CASE

(71) Applicant: Kyocera Document Solutions Inc., Osaka (JP)

(72) Inventor: Takeshi Ishii, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/012,564

(22) Filed: Aug. 28, 2013

(65) Prior Publication Data

US 2014/0064796 A1 Mar. 6, 2014

(30) Foreign Application Priority Data

Aug. 29, 2012 (JP) ..... 2012-188293

(51) Int. Cl.
*G03G 15/08* (2006.01)

(52) U.S. Cl.
CPC ..... *G03G 15/0875* (2013.01); *G03G 15/0832* (2013.01); *G03G 15/0865* (2013.01); *G03G 2215/0827* (2013.01)

(58) Field of Classification Search
USPC ..... 399/263, 262, 256
See application file for complete search history.

(56) References Cited

U.S. PATENT DOCUMENTS

| | | | | |
|---|---|---|---|---|
| 5,797,074 | A * | 8/1998 | Kasahara et al. | 399/262 |
| 6,389,257 | B1 * | 5/2002 | Harumoto et al. | 399/262 |
| 2004/0228649 | A1 * | 11/2004 | Ban et al. | 399/106 |
| 2008/0170889 | A1 | 7/2008 | Eto et al. | |
| 2010/0329747 | A1 * | 12/2010 | Kouda | 399/262 |

* cited by examiner

*Primary Examiner* — Rodney Bonnette
(74) *Attorney, Agent, or Firm* — K&L Gates LLP

(57) ABSTRACT

A toner case includes a case body, a cover, and a conveying member. The cover covers the outer surface of a wall at an end of the case body. The conveying member, including a first attaching assembly, a second attaching assembly and a linking assembly, is rotatably attached to the case body and feeds toner. The first attaching assembly is rotatably attached to the wall. The second attaching assembly is rotatably attached to a wall at the other end of the case body. One end and the other end of the linking assembly are respectively linked to the first attaching assembly and second attaching assembly. One end is slidable in the longitudinal direction of the conveying member. The linking assembly rotates together with the first and second attaching assemblies. The first attaching assembly engages the cover's inner surface, preventing the first attaching assembly from coming off the one-end wall.

14 Claims, 12 Drawing Sheets

TONER CASE INCLUDING CONVEYING MEMBER ATTACHED TO CASE BODY AND IMAGE FORMING APPARATUS INCLUDING TONER CASE

INCORPORATION BY REFERENCE

This application is based upon, and claims the benefit of priority from the corresponding Japanese Patent Application No. 2012-188293, filed Aug. 29, 2012, the entire contents of which are incorporated herein by reference.

BACKGROUND

The present disclosure relates to toner cases that contain toner and image forming apparatuses that include the toner case.

In developing processing by an electrophotographic image forming apparatus, toner is supplied from a developing unit to an electrostatic latent image formed on the surface of a photosensitive drum or the like. A toner case, such as a toner container or an intermediate hopper, is used to supply toner to the developing unit.

An example of a toner case includes a case body that contains toner, a conveying member, which is rotatably attached to the case body, and an agitating member, which is rotatably attached to the case body together with the conveying member. With this toner case, a coupling is attached to one end of the conveying member. To rotate the conveying member, a rotational driving force is transmitted from a driving motor to the coupling. At the one end of the conveying member, a conveying gear is provided, adjacent to the coupling. The conveying gear engages an agitating gear having a large diameter, which is positioned at one end of the agitating member. Therefore, when the conveying member is rotated, the agitating member is also rotated.

Since the above toner case uses an agitating gear having a large diameter, however, there are restrictions on the location and size of the filling port through which toner is supplied to the case body. When a metal mold is used to manufacture the conveying member, only the coupling is typically molded by using a separate insert. With the above toner case, however, the coupling and conveying gear are adjacent to each other, so a portion of the metal mold, where the conveying gear is molded, may be scratched when the insert used to mold the coupling is replaced.

Another type of toner case is designed so that most of the conveying member is located in the case body. With this type of toner case, a large load may be applied to the conveying member due to, for example, the weight of toner supplied to the case body or a shock caused when the toner case drops. If the conveying member is structured by linking a plurality of members to improve ease of assembling or for another purpose, the above load is exerted on linked portions of the plurality of members, possibly damaging the linked portion.

SUMMARY

A toner case according to an embodiment of the present disclosure includes a case body, a cover, and a conveying member. The case body includes a discharge port through which toner is discharged. The cover covers the outer surface of a one-end wall at one end of the case body. The conveying member, which includes a first attaching assembly, a second attaching assembly and a linking assembly, is rotatably attached to the case body and feeds toner toward the discharge port. The first attaching assembly is rotatably attached to the one-end wall. The second attaching assembly is rotatably attached to an another-end wall at another end of the case body. The linking assembly is located in the case body; one end of the linking member is linked to the first attaching assembly so as to be slidable in a longitudinal direction of the conveying member, and another end of the linking assembly is linked to the second attaching assembly. Therefore, the linking assembly is rotated together with the first attaching assembly and second attaching assembly. The first attaching assembly is engaged with the inner surface of the cover to prevent the first attaching assembly from coming off the one-end wall.

An image forming apparatus according to an embodiment of the present disclosure includes the toner case described above.

Additional features and advantages are described herein, and will be apparent from the following Detailed Description and the figures.

DETAILED DESCRIPTION

Figure 1:
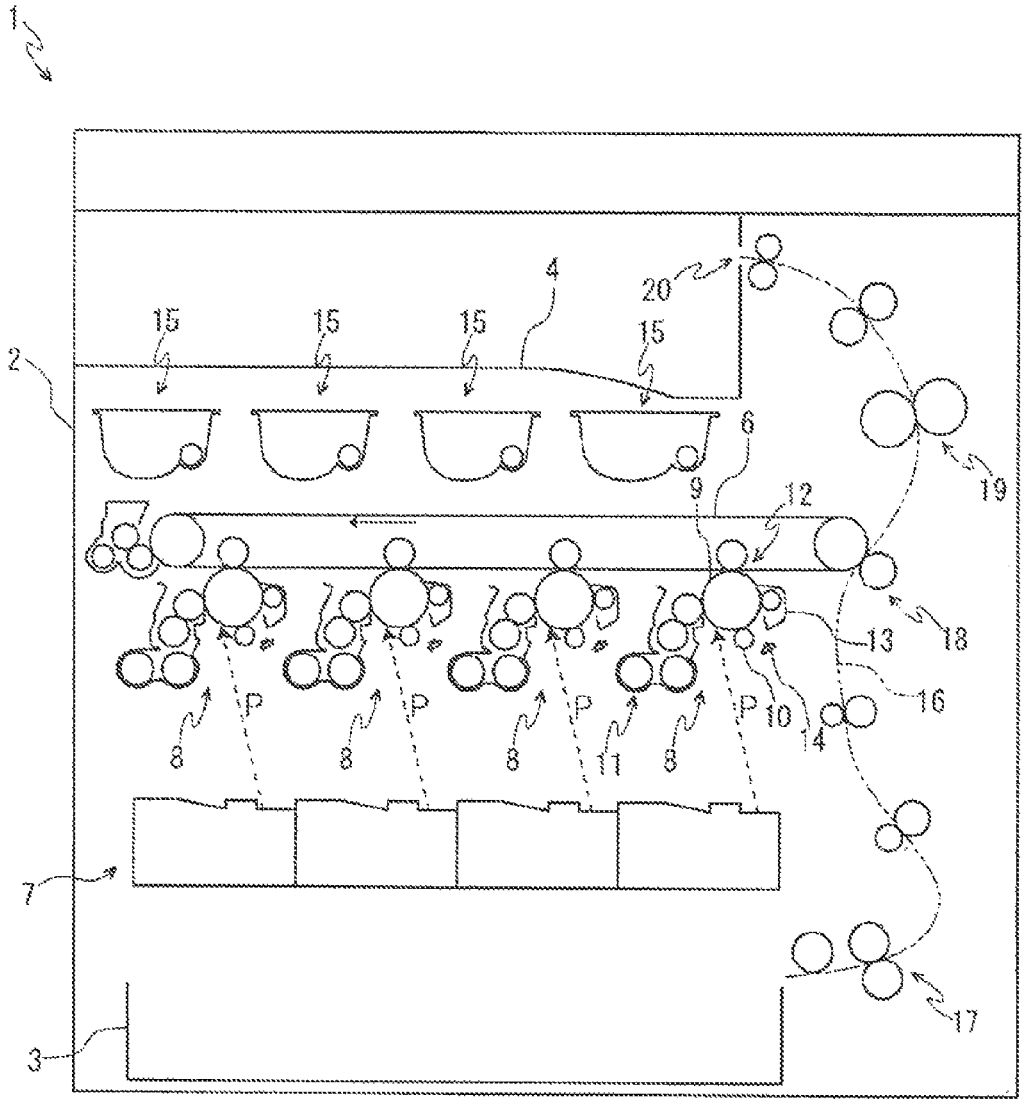
FIG. 1 schematically illustrates the structure of a color printer according to an embodiment of the present disclosure.

The general structure of a color printer 1 used as an image forming apparatus will be described first with reference to FIG. 1. FIG. 1 schematically illustrates the structure of a color printer according to an embodiment of the present disclosure.

The color printer 1 includes a box-like printer body 2. A paper feed cassette 3, in which paper (not illustrated) is placed, is located at the bottom of the printer body 2. A paper discharge tray 4 is located at the top of the printer body 2.

An intermediate transfer belt 6 is suspended by a plurality of rollers at the center of the printer body 2. An exposing device 7, formed with a laser scanning unit (LSU), is positioned below the intermediate transfer belt 6. In the vicinity of the intermediate transfer belt 6, four image forming units 8 are located along the lower part of the intermediate transfer belt 6, corresponding to the colors of toners (four colors of magenta, cyan, yellow, and black, for example). A photosensitive drum 9 is rotatably attached to each image forming unit 8. A charging unit 10, a developing unit 11, a primary transfer unit 12, a cleaning device 13, and a static eliminator 14 are positioned around the photosensitive drum 9 in the order of primary transfer processes. Toner containers 15, as toner cases are positioned, above the developing units 11 corresponding to the image forming units 8, one toner container 15 being provided for each toner color.

A conveying path 16, through which paper is fed, is located on one side (right side on the drawing) of the printer body 2. A paper feed unit 17 is located at the upstream end of the conveying path 16. At an intermediate point of the conveying path 16, a secondary transfer unit 18 is positioned at one end (right side on the drawing) of the intermediate transfer belt 6. A fixing device 19 is located near the downstream end of the conveying path 16. A paper discharge port 20 is positioned at the downstream end of the conveying path 16.

Next, image forming operation executed by the color printer 1 will be described. When the color printer 1 is turned on, parameters are initialized and the initial values of the temperature setting of the fixing device 19 and the like are set. When image data is then inputted from, for example, a computer connected to the color printer 1 to command the color printer 1 to start printing, an image forming operation is performed as described below.

The surface of each photosensitive drum 9 is charged by its corresponding charging unit 10 first, after which an electrostatic latent image is formed on the surface of the photosensitive drum 9 with a laser beam (indicated by arrow P) of the exposing device 7. Next, the developing unit 11 develops the electrostatic latent image to generate a toner image in the corresponding color. In the primary transfer unit 12, this toner image is subjected to a primary transfer to the surface of the intermediate transfer belt 6. This operation is repeated by all image forming units 8 in succession to form a full-color toner image on the intermediate transfer belt 6. Toner and charges remaining on the photosensitive drum 9 are removed by the cleaning device 13 and static eliminator 14.

Paper is pulled by the paper feed unit 17 from the paper feed cassette 3 or the manual tray (not illustrated) and is then fed to the secondary transfer unit 18 at a timing that matches the above image forming operation. The secondary transfer unit 18 secondarily transfers the full-color toner image on the intermediate transfer belt 6 to the paper. The paper with the secondarily transferred toner image is fed on the conveying path 16 downstream and enters the fixing device 19. The toner image is fixed by the fixing device 19. The paper with the fixed toner image passes through the paper discharge port 20 and is discharged onto the paper discharge tray 4.

Next, the toner container 15 will be described with reference to FIGS. 2 to 11. The arrow Fr on FIG. 2 and later drawings indicates the direction toward the front side of the toner container 15.

The toner container 15 is removably attached to the printer body 2. When the user opens a front cover (not illustrated) attached to the front side of the printer body 2, the user can replace the toner container 15.

Figure 2:
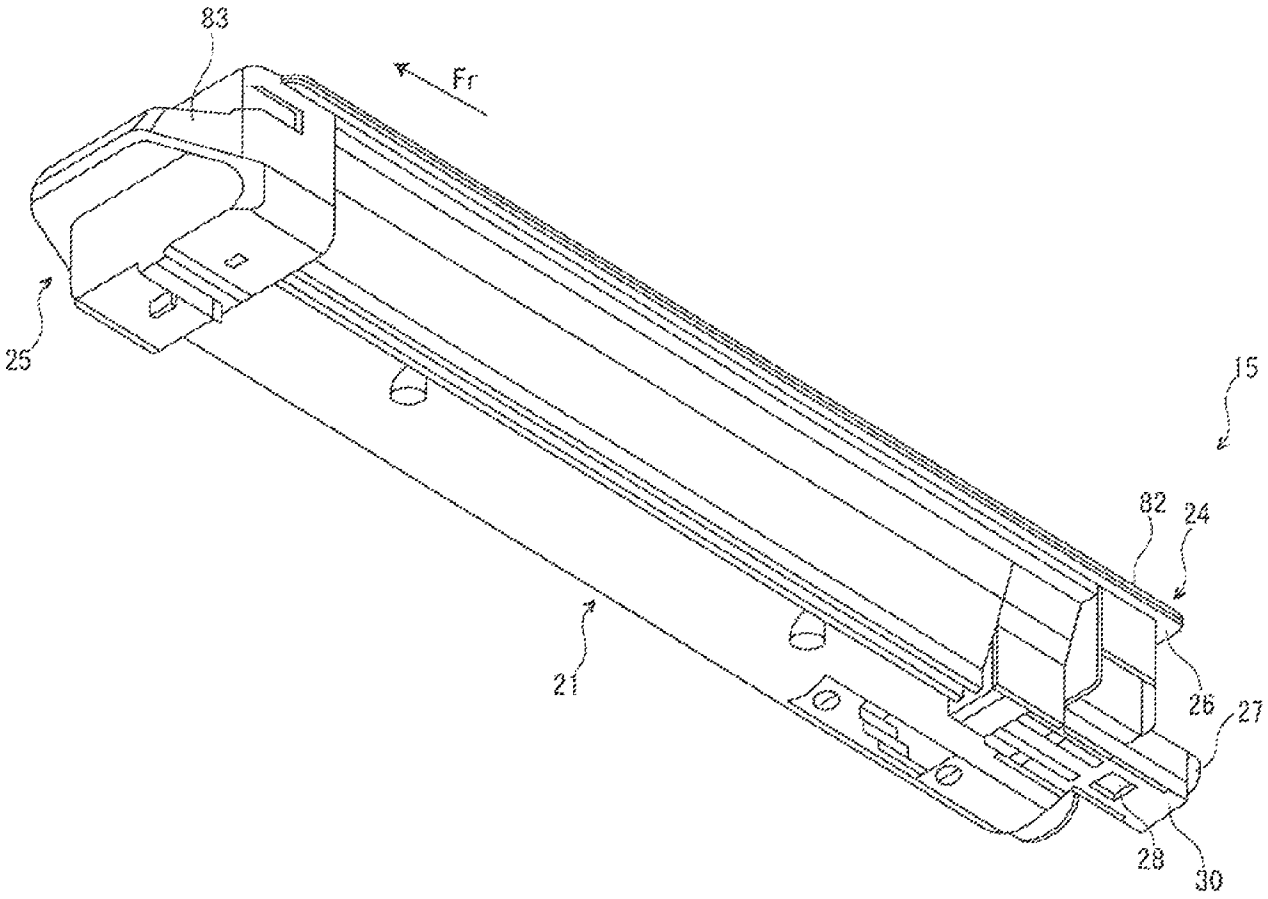
FIG. 2 is a perspective view of a toner container of the color printer according to an embodiment of the present disclosure when viewed from the bottom at the front.
Figure 3:
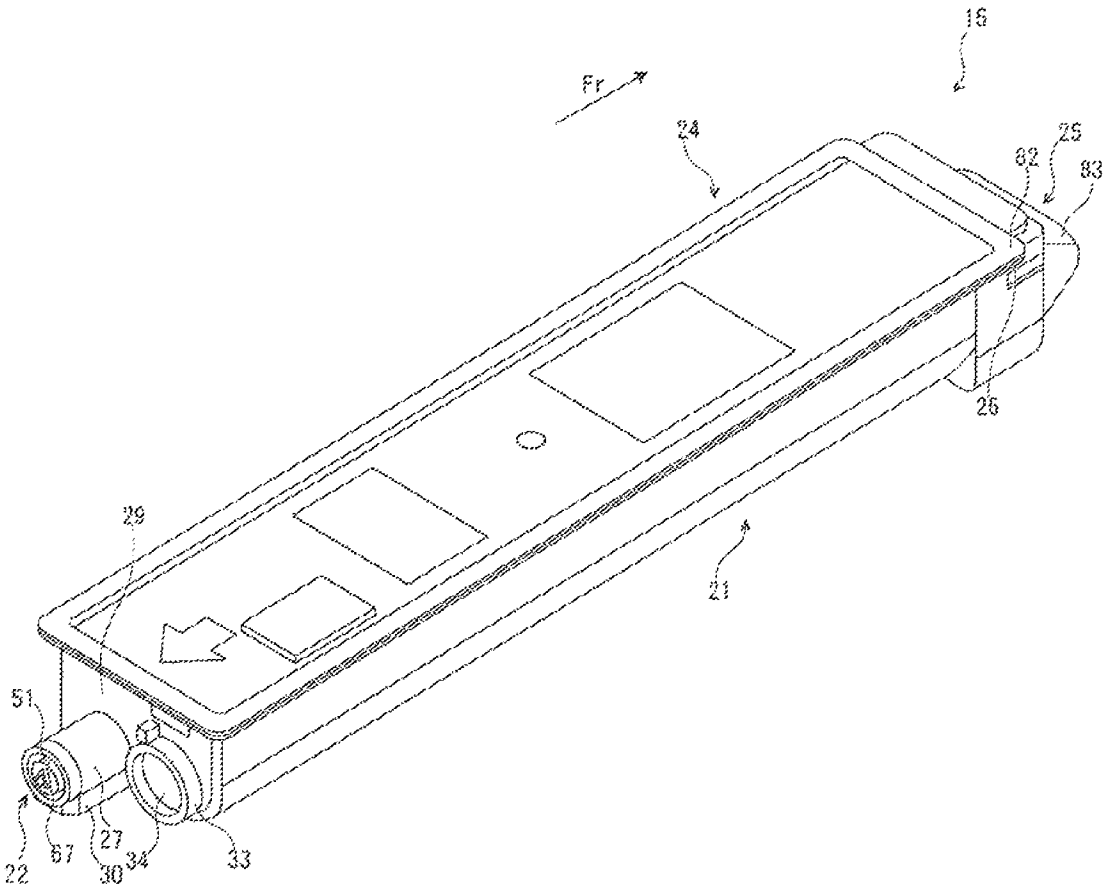
FIG. 3 is a perspective view of the toner container of the color printer according to an embodiment of the present disclosure when viewed from above at the back.

As illustrated in FIGS. 2 and 3, the toner container 15 is elongated in its fore-aft (longitudinal) direction. The toner container 15 includes a box-like case body 21 with an opening at the top, a conveying screw 22, used as a conveying member, which is rotatably attached to the lower right portion of the case body 21 (only the rear end of the conveying screw 22 is illustrated in FIG. 3), an agitating paddle 23 (see FIG. 5), used as an agitating member, which is rotatably attached to a substantially central part of the case body 21, a lid 24 that covers the upper surface of the case body 21, and a cover 25 attached to the front end of the case body 21.

First, the case body 21 will be described. The case body 21, which contains toner, is elongated in its fore-aft direction. A main-body-side flange 26 is located around the outer circumference on the top of the case body 21.

Figure 4:
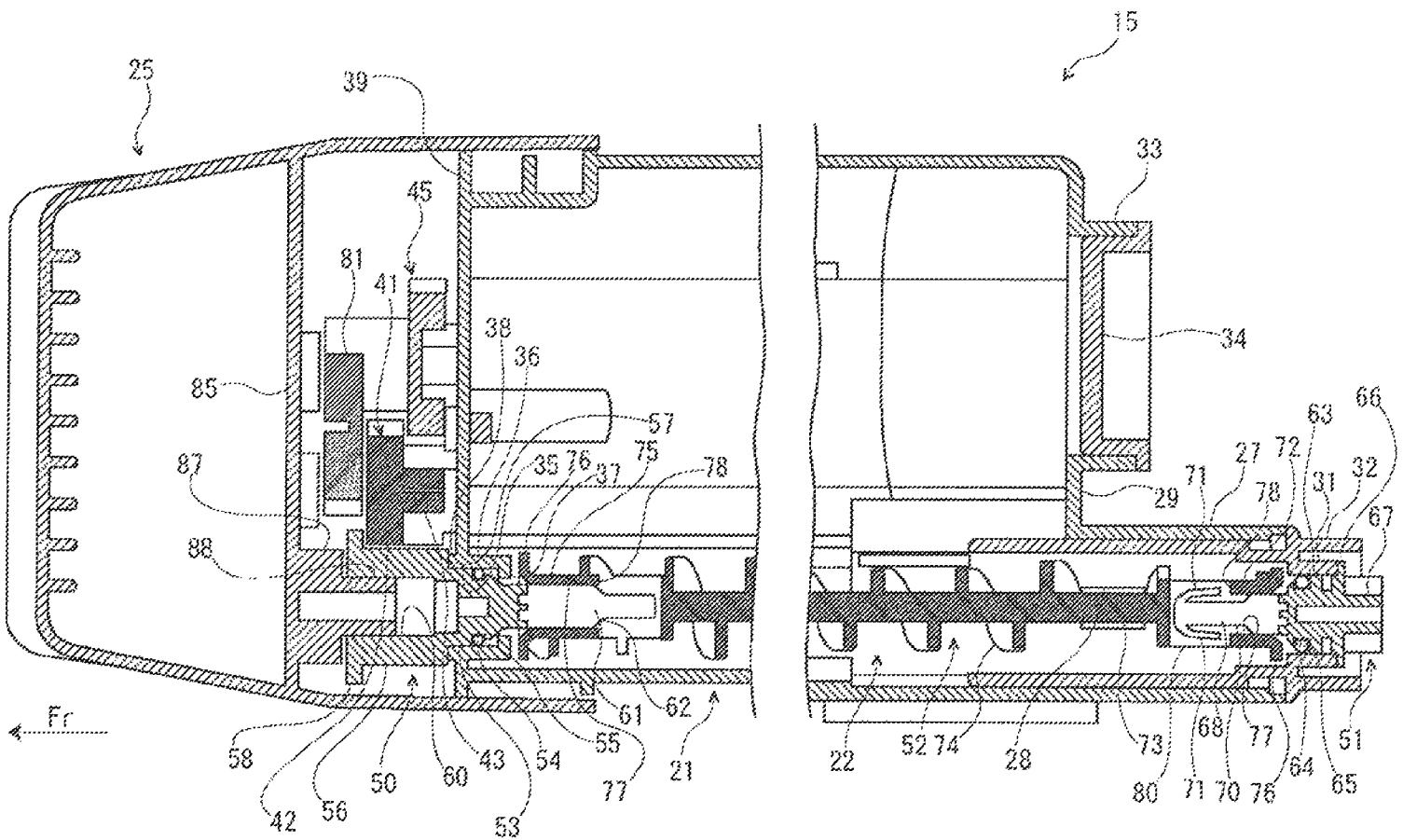
FIG. 4 is a plan cross-sectional view of the toner container of the color printer according to an embodiment of the present disclosure.

A cylindrical discharge duct 27 protrudes from the lower right portion of a rear-end wall 29 (another end wall) of the case body 21. A discharge port 28 (see FIG. 2), through which toner is discharged, is located at the bottom of the discharge duct 27. The discharge port 28 is removably covered by a slidable shutter 30 (FIG. 2 illustrates the state when the shutter 30 opens the discharge port 28). As illustrated in FIG. 4, an end cylinder 31, which is cylindrical, is located at the rear end of the discharge duct 27 and a guide cylinder 32, which is cylindrical, is located so as to cover the outer circumference of the end cylinder 31. A filling port 33, through which toner is supplied to the case body 21, is located on the left side of the rear-end wall 29. The filling port 33 is covered by a cap 34.

A circular communicating hole 35 is formed on the right side at the bottom of a front-end wall 39 (one-end wall at one end) of the case body 21. On the inner surface (rear surface) of the front-end wall 39, an attachment cylinder 36, which is cylindrical, protrudes from the outer circumference of the circular communicating hole 35. At the rear end of the attachment cylinder 36, an inner-circumferential protrusion 37, which is annular, is provided. On the outer surface (front surface) of the front-end wall 39, an annular base 38 protrudes from the outer circumference of the circular communicating hole 35.

Figure 5:
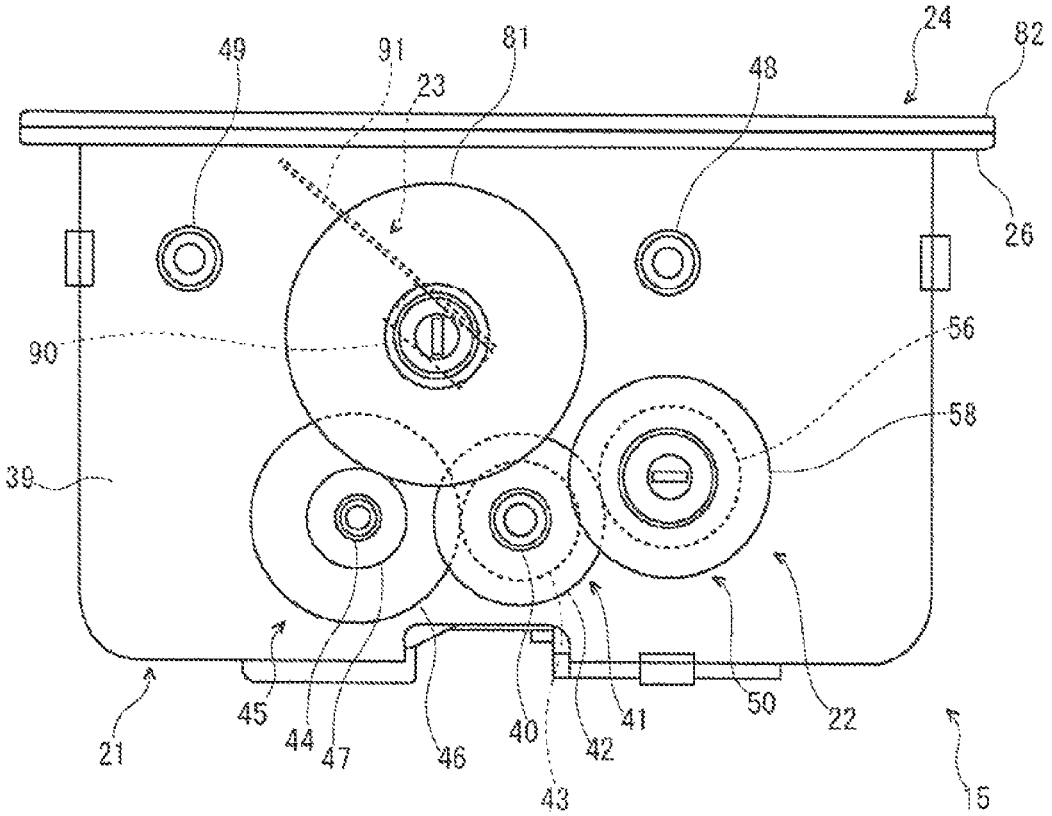
FIG. 5 is a front view of the color printer according to an embodiment of the present disclosure with the cover removed.
Figure 6:
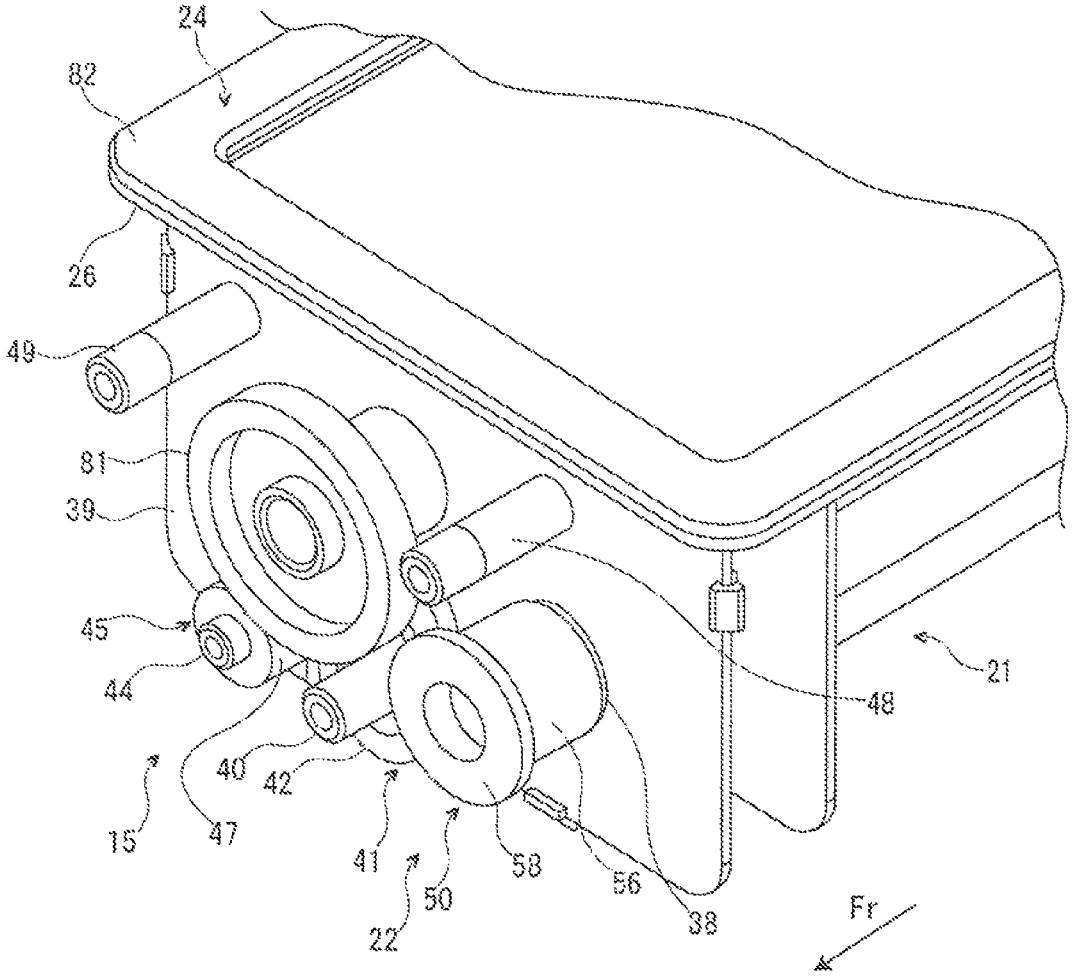
FIG. 6 is a perspective view of the front of the toner container of the color printer according to an embodiment of the present disclosure with the cover removed.

As illustrated in FIGS. 5 and 6, a first boss 40, which is cylindrical, protrudes from the center at the bottom of the outer surface (front surface) of the front-end wall 39. A first idle gear 41 is rotatably attached to the outer circumference of the first boss 40. The first idle gear 41 includes a large-diameter gear 42 and a small-diameter gear 43, which is positioned behind the large-diameter gear 42. A second boss 44 protrudes from the left side at the bottom of the outer surface of the front-end wall 39. A second idle gear 45 is rotatably attached to the outer circumference of the second boss 44. The second idle gear 45 includes a large-diameter part 46, which engages the small-diameter gear 43 of the first idle gear 41, and a small-diameter part 47, which is positioned in front of the large-diameter part 46. A third boss 48 protrudes from the right side at the top of the outer circumference of the front-end wall 39, and a fourth boss 49 protrudes from the left side at the top of the outer circumference of the front-end wall 39.

Figure 7:
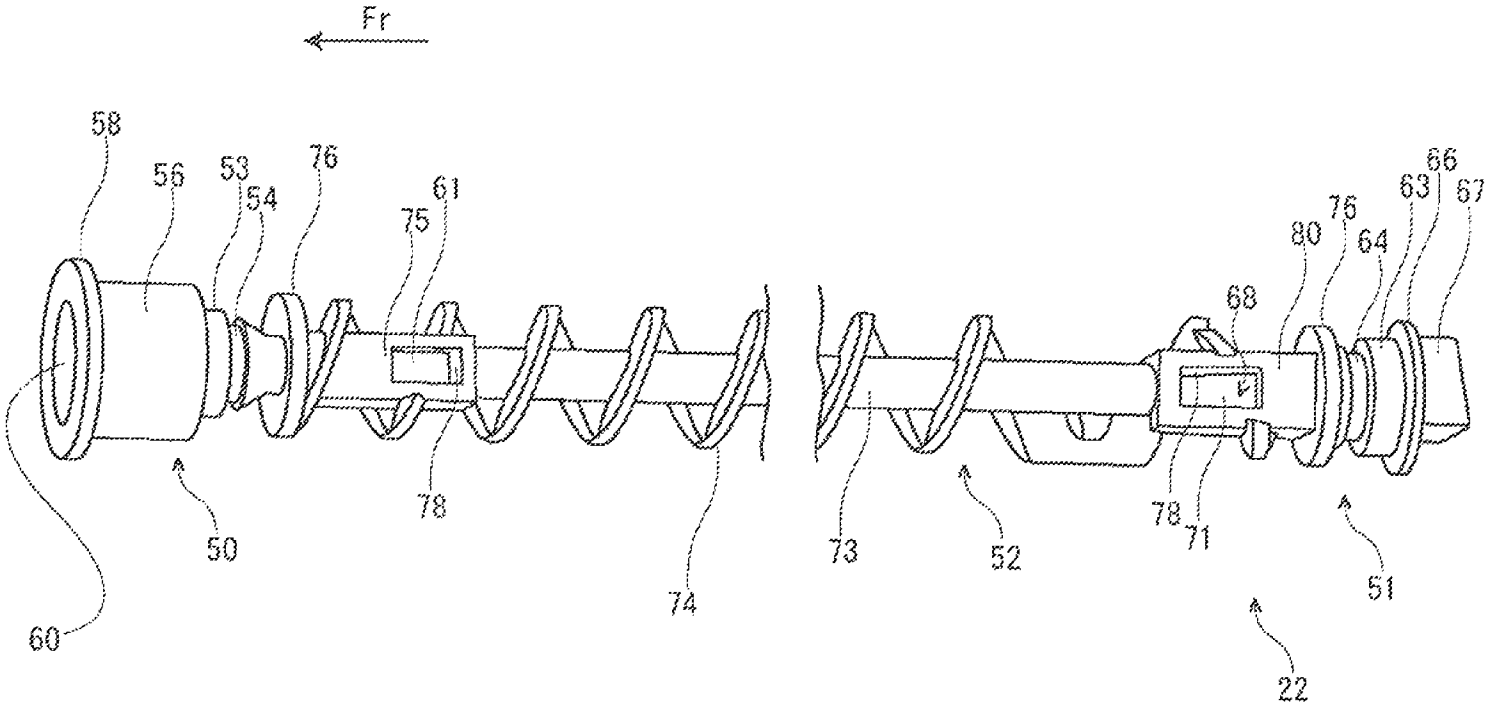
FIG. 7 is a perspective view of a conveying screw in the toner container of the color printer according to an embodiment of the present disclosure.

Next, the conveying screw 22 will be described. As illustrated in FIGS. 4 and 7, the conveying screw 22 is elongated in its fore-aft direction. That is, in this embodiment, the fore-and-aft direction is the longitudinal direction of the conveying screw 22. The conveying screw 22 includes a first attaching assembly 50, which is rotatably attached to the front-end wall 39 of the case body 21, a second attaching assembly 51, which is rotatably attached to the rear-end wall 29 of the case body 21, and a linking assembly 52, the front end of which is linked to the first attaching assembly 50 and the rear end of which is linked to the second attaching assembly 51.

Figure 8:
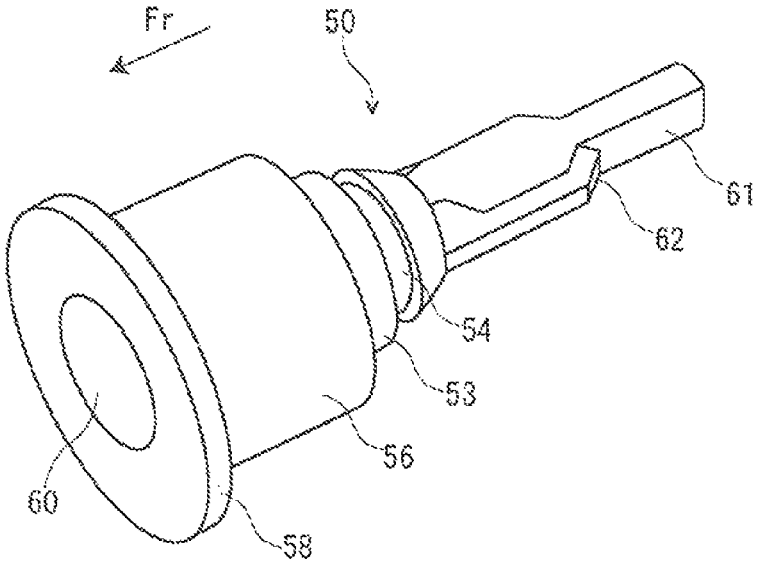
FIG. 8 is a perspective view of a first attaching assembly in the toner container of the color printer according to an embodiment of the present disclosure.

As illustrated in FIGS. 4 and 8, a passing part 53 is formed substantially at the center of the first attaching assembly 50 in the fore-and-aft direction. The passing part 53 passes through the base 38 on the front-end wall 39, the circular communicating hole 35 in the front-end wall 39, and the attachment cylinder 36 on the front-end wall 39. An attaching groove 54 is formed at the center of the passing part 53 in the fore-and-aft direction. An O-ring 55 (see FIG. 4) is attached to the attaching groove 54. The O-ring 55 abuts the inner circumferential surface of the attachment cylinder 36 on the front-end wall 39. The rear of the passing part 53 is tapered so that its diameter is reduced and abuts the inner-circumferential protrusion 37 of the attachment cylinder 36.

A conveying gear 56 is positioned at the front of the first attaching assembly 50. The conveying gear 56 protrudes toward the outside (front) of the front-end wall 39 and engages the large-diameter gear 42 of the first idle gear 41. The conveying gear 56 has a greater diameter than the passing part 53. A circular step 57 (see FIG. 4) is formed between the conveying gear 56 and the passing part 53. The step 57 abuts the base 38 of the front-end wall 39, restricting the backward movement of the first attaching assembly 50. An engaged part 58 shaped like a flange is located at the front end of the first attaching assembly 50. As with the conveying gear 56, the engaged part 58 protrudes toward the outside of the front-end wall 39. In the first attaching assembly 50, an insertion hole 60 is formed extending from the front surface of the engaged part 58 to the passing part 53.

A fitting part 61, shaped like a straight bar, is positioned at the rear of the first attaching assembly 50 so as to extend in the fore-aft direction. The fitting part 61 is inserted into the interior of the front-end wall 39. An inclined part 62, which is tapered toward the rear, is located substantially at the center of the fitting part 61 in the fore-aft direction.

Figure 9:
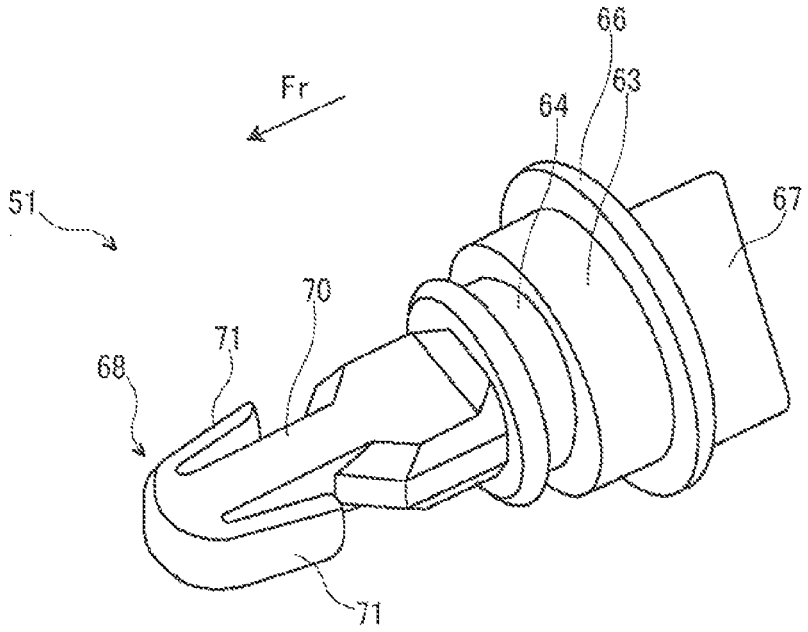
FIG. 9 is a perspective view of a second attaching assembly in the toner container of the color printer according to an embodiment of the present disclosure.

As illustrated in FIGS. 4 and 9, a passing part 63 is located substantially at the center of the second attaching assembly 51 in the fore-aft direction. The passing part 63 passes through the end cylinder 31 positioned in the discharge duct 27 of the rear-end wall 29. An attaching groove 64 is formed in front of the passing part 63. An O-ring 65 (see FIG. 4) is attached to the attaching groove 64. The O-ring 65 abuts the inner circumferential surface of the end cylinder 31.

An annular flange 66 is positioned at the rear of the second attaching assembly 51. The flange 66 protrudes toward the outside (rear) of the rear-end wall 29. The flange 66 abuts the rear end of the end cylinder 31, restricting the forward movement of the second attaching assembly 51. A coupling 67 is located at the rear end of the second attaching assembly 51. As with the flange 66, the coupling 67 protrudes toward the outside of the rear-end wall 29. The coupling 67 is shaped in, for example, a triangle form when viewed from the rear (see FIG. 3).

A hook 68 is located at the front of the second attaching assembly 51. The hook 68 includes a base 70, which is shaped like a straight bar and extends in the fore-aft direction, and a pair of engaging parts 71, which is positioned at an end of the base 70. Each engaging part 71 is spaced more apart from the base 70 toward the rear.

Figure 10:
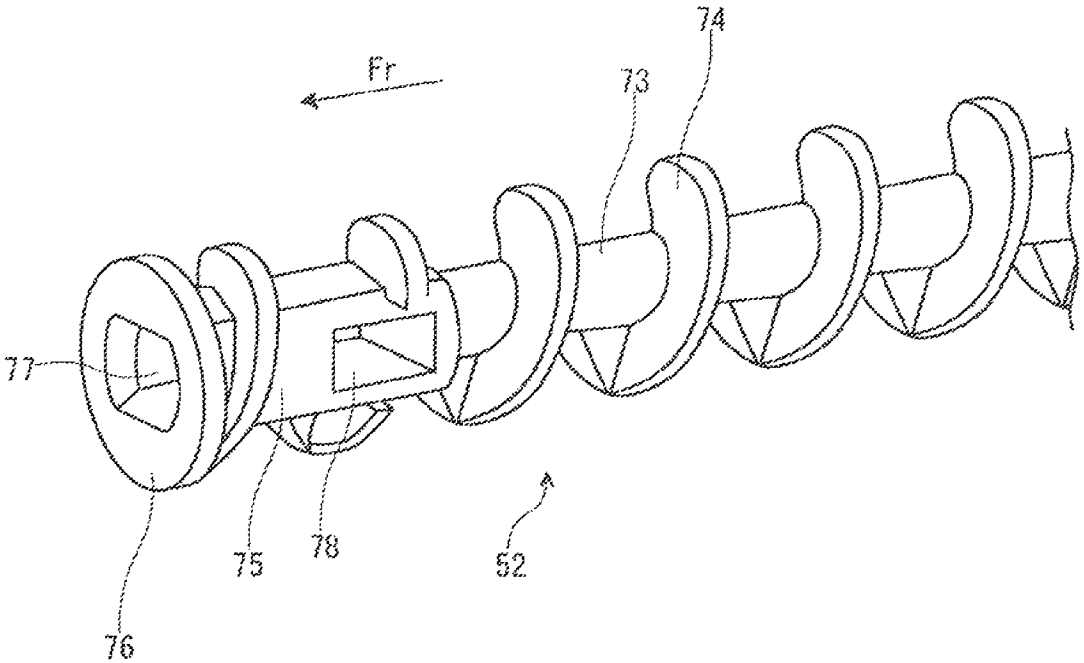
FIG. 10 is a perspective view of the front of a linking assembly in the toner container of the color printer according to an embodiment of the present disclosure.

The linking assembly 52 is accommodated in the case body 21. As illustrated in FIGS. 4 and 10, the linking assembly 52 includes a rotational axis 73 shaped like a straight bar and a fin 74 provided around the rotational axis 73 in a spiral form. A first fitting member 75 is positioned at the front end of the rotational axis 73, and a circular collar 76 is located at the front end of the first fitting member 75. A fitting hole 77, which backwardly extends from the circular collar 76, is formed in the first fitting member 75. The fitting part 61 of the first attaching assembly 50 is fitted into the fitting hole 77, linking the front end of the linking assembly 52 to the first attaching assembly 50 so as to be slidable in the fore-aft direction. A fitting hole 78 is formed at the rear of the first fitting member 75 as a linking-assembly-side fitting part, which communicates with the fitting hole 77.

As illustrated in FIG. 7, a second fitting member 80 is positioned at the rear end of the rotational axis 73. Since the second fitting member 80 is shaped so as to be substantially symmetric with the first fitting member 75 in the fore-aft direction, the same elements of the second fitting member 80 as elements of the first fitting member 75 are denoted by the same reference numerals and duplicate descriptions will be omitted. The base 70 of the hook 68 of the second attaching assembly 51 is fitted into the fitting hole 77 in the second fitting member 80. The engaging part 71 of the hook 68 is fitted into the fitting hole 78 in the second fitting member 80. Thus, the rear end of the linking assembly 52 is linked to the second attaching assembly 51 so that the linking assembly 52 cannot slide in the fore-aft direction.

Next, the agitating paddle 23 will be described. As illustrated in FIG. 5, the agitating paddle 23 includes a support frame 90 shaped like a frame plate and an agitating blade 91, shaped like a blade, which is supported by the support frame 90. The front end of the support frame 90 is pivotably supported to the front-end wall 39, and the rear end is pivotably supported to the rear-end wall 29. An agitating gear 81 is located at the front end of the support frame 90 so as to pass through the front-end wall 39 and protrude toward the outside of the front-end wall 39. The agitating gear 81 engages the small-diameter part 47 of the second idle gear 45 and is connected to the conveying gear 56 via the idle gears 41 and 45.

Next, the lid 24 will be described. As illustrated in FIG. 3 and other drawings, the lid 24 has a rectangular shape that is elongated in the fore-aft direction. A lid-side flange 82, the shape of which matches the shape of the main-body-side flange 26 of the case body 21, is positioned around the outer circumference of the lid 24. The main-body-side flange 26 and lid-side flange 82 are ultrasonically welded so that the case body 21 and lid 24 are integrated into one member.

Figure 11:
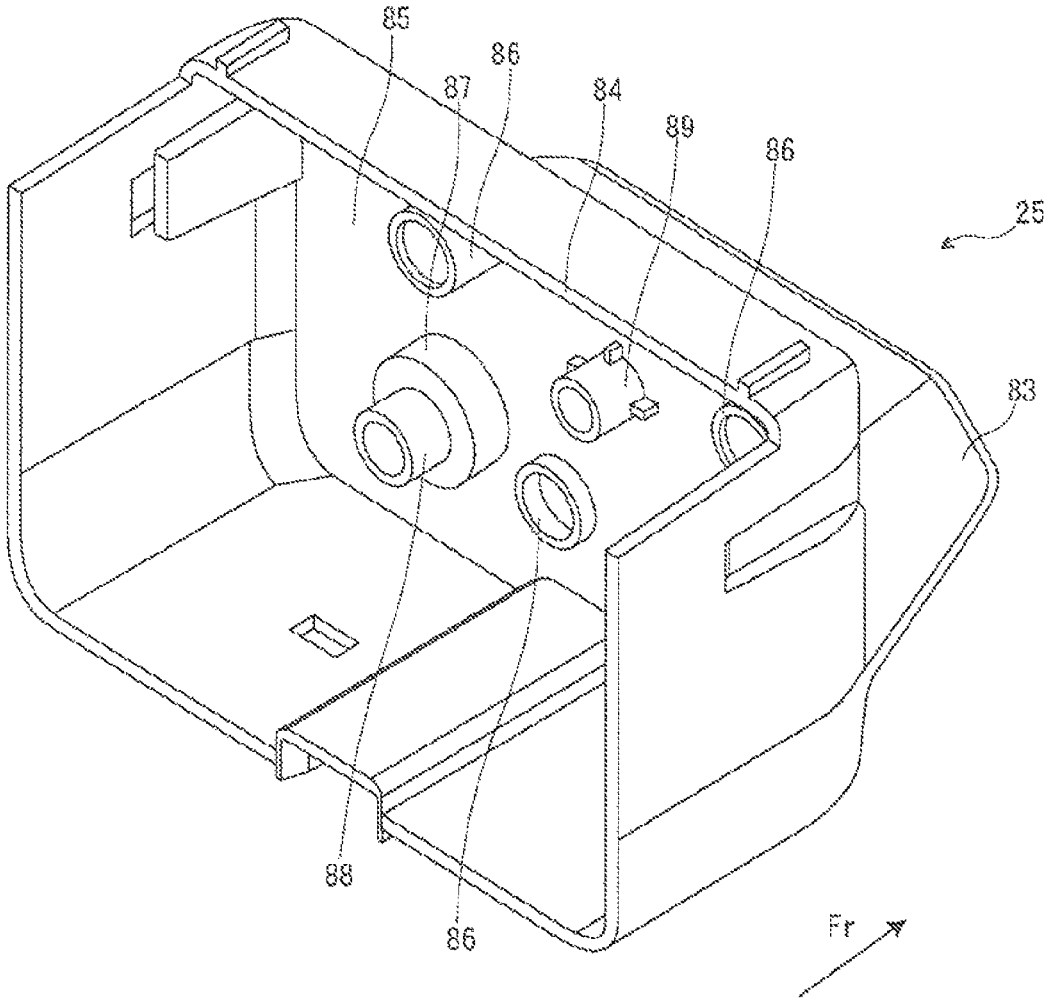
FIG. 11 is a perspective view of the cover of the toner container of the color printer according to an embodiment of the present disclosure when viewed from the left at the back.

Next, the cover 25 will be described. The cover 25 is located so as to cover the outer surface of the front-end wall 39 of the case body 21. As illustrated in FIG. 11, the cover 25 has a box-like shape including an opening at the rear. The cover 25 includes a grasping part 83 that extends forwardly. A notch 84, which extends from the front to the rear end, is formed on the upper surface of the cover 25.

The cover 25 includes a partition plate 85, which partitions its inner space in the fore-aft direction. On the inner surface (rear surface) of the partition plate 85, cylindrical boss receivers 86 protrude at positions corresponding to the bosses 40, 44, 48, and 49 positioned on the outer surface of the front-end wall 39. When the cover 25 is attached to the case body 21, the bosses 40, 44, 48, and 49 are inserted into their corresponding boss receivers 86.

A protrusion 87 is formed at the lower right of the inner surface of the partition plate 85. When the engaged part 58 of the first attaching assembly 50 of the conveying screw 22 is engaged with the protrusion 87, this engagement prevents the first attaching assembly 50 from coming off the front-end wall 39 (see FIG. 4). The protrusion 87 is formed so as to be thicker than its periphery. An insertion part 88 protrudes at the center of the protrusion 87. The insertion part 88 is inserted into the insertion hole 60 formed in the first attaching assembly 50 of the conveying screw 22. At the upper portion of the rear surface of the partition plate 85, an engaging boss 89 (see FIG. 11) is located at a position corresponding to the agitating gear 81 of the agitating paddle 23.

An operation of the color printer 1, as described above, by which toner is supplied from the toner container 15 to the developing unit 11 will be described.

When a driving force is transmitted from a driving source (not illustrated), such as a motor, provided for the printer body 2 to the coupling 67 attached to the second attaching assembly 51 of the conveying screw 22, the conveying screw 22 rotates (specifically, the linking assembly 52 rotates together with the first attaching assembly 50 and second attaching assembly 51). Accordingly, toner in the case body 21 is fed toward the discharge port 28, discharged from the discharge port 28, and then supplied to the developing unit 11.

When the conveying screw 22 is rotated as described above, the conveying gear 56 attached to the first attaching assembly 50 of the conveying screw 22 rotates. This rotation of the conveying gear 56 is transmitted via the first idle gear 41 and second idle gear 45 to the agitating gear 81 of the agitating paddle 23, rotating the agitating paddle 23. When the agitating paddle 23 rotates in this way, the toner in the case body 21 is fed toward the conveying screw 22 while being agitated.

Next, an operation performed when an external force is applied to the conveying screw 22 will be described with reference mainly to FIGS. 12A and 12B.

Figure 12A:
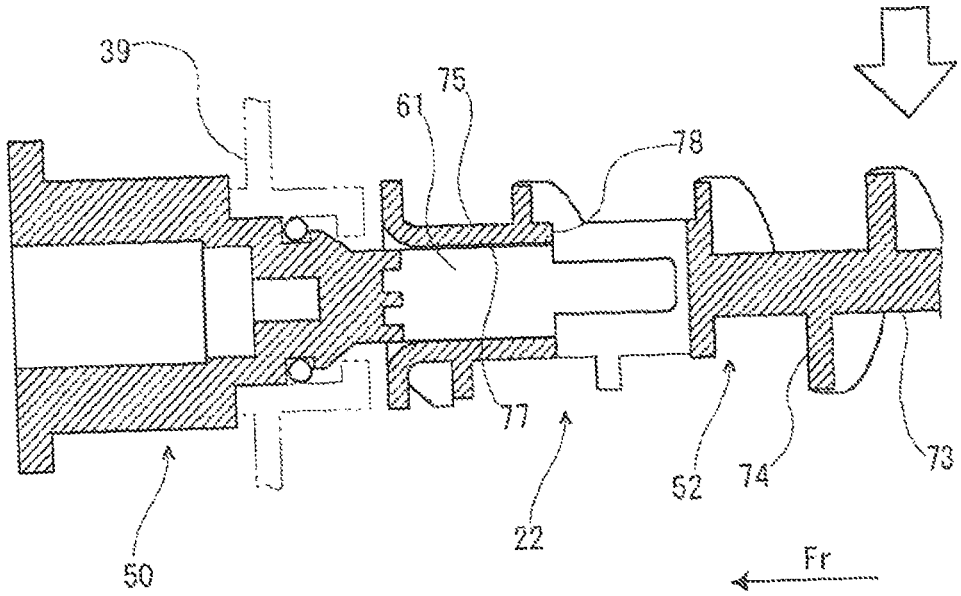
FIG. 12A is a cross-sectional view of the conveying screw in the toner container of the color printer according to an embodiment of the present disclosure when an external force is not applied.
Figure 12B:
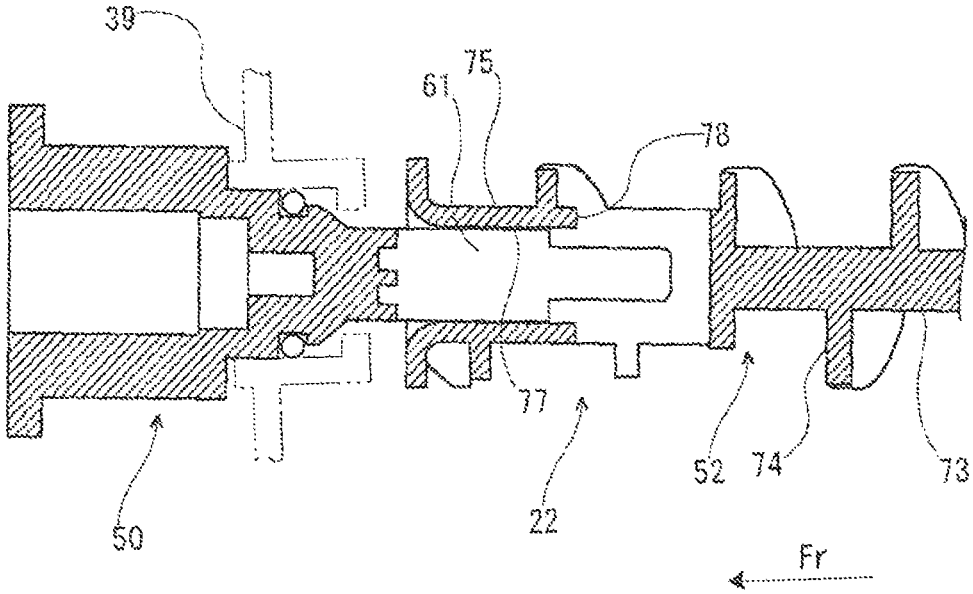
FIG. 12B is a cross-sectional view of the conveying screw when an external force is applied.

When, for example, toner is supplied to the toner container 15, an external force is applied in a direction (downward, for example) in which the conveying screw 22 is warped due to the weight of the toner as indicated by the hollow arrow in FIG. 12A. When the toner container 15 is dropped, an external force is similarly applied in a direction in which the conveying screw 22 is warped due to the impact of the drop. Even if an external force is applied to the conveying screw 22 as described above, the front end of the linking assembly 52 slides backward from the first attaching assembly 50 as illustrated in FIG. 12B and the external force is thereby absorbed, reducing a load applied to the linked portions between the first attaching assembly 50 and the linking assembly 52 and between the second attaching assembly 51 and the linking assembly 52. This prevents the linked portions between the first attaching assembly 50 and the linking assembly 52 and between the second attaching assembly 51 and the linking assembly 52 (particularly, the engaging part 71 of the hook 68) from being damaged.

In this embodiment, it is possible to slide the front end of the linking assembly 52 in the fore-aft direction with a simple structure in which the fitting part 61 of the first attaching assembly 50 is only fitted into the fitting hole 77 formed at the front end of the linking assembly 52.

The hook 68 attached to the second attaching assembly 51 is fitted into the fitting hole 78 formed at the rear end of the linking assembly 52. Therefore, it is possible to slide the front end of the linking assembly 52 with respect to the first attaching assembly 50 and to firmly secure the rear end of the linking assembly 52 to the second attaching assembly 51.

The coupling 67 of the toner container 15 has a substantially triangular shape when viewed from the rear, as described above. Corresponding to the coupling 67, a main-body-side coupling (not illustrated) is located on the printer body 2, the main-body-side coupling having a substantially triangular shape when viewed from the front. When the main-body-side coupling and the coupling 67 of the toner container 15 are linked together, the rotational driving force from the driving source (not illustrated) is transmitted to the coupling 67.

A coupling attached to the toner container 15 in the color printer 1 having different specifications from the color printer 1 in this embodiment has a different shape (a substantially rectangular shape, for example) when compared with this embodiment. Accordingly, if a toner container having different specifications is mistakenly attached to the printer body 2, a rotational driving force is not transmitted from the main-body-side coupling of the printer body 2 to the coupling of the toner container. This prevents the conveying screw and agitating paddle from rotating a mistakenly attached toner container. When this structure is used, it is possible to prevent a toner container having different specifications from being attached by mistake to the printer body 2 and to perform an image forming operation by using optimum toner according to the print quality, print speed, and usage purpose of the color printer 1 to be used.

Only the second attaching assembly 51 may be intentionally replaced; for example, the second attaching assembly 51 including the coupling 67 in a substantially rectangular form may be replaced with the second attaching assembly 51 including the coupling 67 in a substantially triangular form. In this case, it is difficult to prevent a toner container having different specifications from being attached by mistake.

In this embodiment, however, when the second attaching assembly 51 is pulled out, with the cover 25 removed, to delink the second attaching assembly 51 from the linking assembly 52, the fitting part 61 of the first attaching assembly 50 comes off the fitting hole 77 in the linking assembly 52 and the linking assembly 52 drops into the case body 21. If the linking assembly 52 drops into the case body 21 in this way, the first attaching assembly 50 and second attaching assembly 51 cannot be linked to the linking assembly 52 again unless the case body 21 and lid 24, which have been ultrasonically welded, are separated. Accordingly, it is possible to prevent the second attaching assembly 51 from being replaced.

Since the conveying gear 56 is connected to the agitating gear 81 with the idle gears 41 and 45 interposed therebetween, the agitating gear 81 can be made smaller when compared with the case in which the conveying gear 56 is connected directly to the agitating gear 81. Since the conveying gear 56 and coupling 67 are attached to separate parts, even if the coupling 67 is molded with a separate insert, it is possible to prevent a metal mold used to mold the conveying gear 56 from being scratched by the insert used to mold the coupling 67.

Since the first attaching assembly 50 is engaged with the protrusion 87 positioned on the inner surface of the partition plate 85 of the cover 25, it is possible to prevent the first attaching assembly 50 from coming off the front-end wall 39. Particularly, since the protrusion 87 is formed so as to be thicker than its periphery, the strength of the protrusion 87 can be increased, more reliably preventing the first attaching assembly 50 from coming off the front-end wall 39. Another embodiment can also be used in which a spacer or a similar member is positioned between the first attaching assembly 50 and the cover 25. In this case, however, the number of parts is increased and the manufacturing cost may be thereby increased.

In an embodiment, the fitting part 61 of the first attaching assembly 50 is shaped in a flat form (see FIG. 8). In another embodiment, however, a small protrusion may be present at the end of the fitting part 61 of the first attaching assembly 50.

An embodiment has been described for the situation in which the shape of the coupling 67 differs in different specifications of the color printer 1. In another embodiment, however, the shape of the coupling 67 may be changed according to, for example, the place of the destination, colors, and other conditions.

In an embodiment, the structure in the present disclosure has been applied to the toner container 15. In another embodiment, however, the structure in the present disclosure may be applied to a toner case (an intermediate hopper, for example) placed between the toner container 15 and the developing unit 11.

An embodiment has been described for the case in which the structure in the present disclosure is applied to the color printer 1. In another embodiment, however, the structure in the present disclosure may be applied to a monochrome printer, a copier, a facsimile machine, a multi-function peripheral, or another image forming apparatus.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A toner case comprising:

a case body that includes a discharge port through which toner is discharged;

a conveying member that is rotatably attached to the case body and feeds toner toward the discharge port; and a cover that covers an outer surface of a one-end wall at one end of the case body;

the conveying member includes a first attaching assembly that is rotatably attached to the one-end wall, a second attaching assembly that is rotatably attached to another-end wall at another end of the case body, and a linking assembly that is located in the case body, one end of the linking assembly being linked to the first attaching assembly so as to be slidable in a longitudinal direction of the conveying member, another end of the linking assembly being linked to the second attaching assembly, the linking assembly being rotated together with the first attaching assembly and the second attaching assembly, and the first attaching assembly is engaged with an inner surface of the cover to prevent the first attaching assembly from coming off the one-end wall.

2. The toner case according to claim 1, wherein a protrusion that engages the first attaching assembly is formed on the inner surface of the cover, and the protrusion is thicker than the cover at a periphery of the protrusion.

3. The toner case according to claim 1, wherein a fitting part that extends in the longitudinal direction of the conveying member is formed on the first attaching assembly, and a fitting hole to which the fitting part is capable of fitting is formed at the one end of the linking assembly along the longitudinal direction of the conveying member.

4. The toner case according to claim 3, wherein the fitting part includes an inclined part that is tapered toward the another end at a center of the longitudinal direction.

5. The toner case according to claim 1, comprising:

an agitating member that is rotatably attached to the case body, the agitating member including an agitating gear;

a conveying gear connected to the agitating gear is attached to the first attaching assembly, and a coupling to which a rotational driving force is transmitted from a driving source is attached to the second attaching assembly.

6. The toner case according to claim 1, wherein the second attaching assembly includes a hook, and a linking-assembly-side fitting part is positioned on the another end of the linking assembly, the hook being capable of engaging the fitting part.

7. The toner case according to claim 1, wherein a boss is formed on the one-end wall, and on the inner surface of the cover, a boss receiver is formed at a position corresponding to the boss.

8. An image forming apparatus comprising:

a toner case that includes a case body that includes a discharge port through which toner is discharged, a conveying member that is rotatably attached to the case body and feeds toner toward the discharge port, and a cover that covers an outer surface of a one-end wall at one end of the case body, the conveying member includes a first attaching assembly that is rotatably attached to the one-end wall, a second attaching assembly that is rotatably attached to another-end wall at another end of the case body, and a linking assembly that is located in the case body, one end of the linking assembly being linked to the first attaching assembly so as to be slidable in a longitudinal direction of the conveying member, another end of the linking assembly being linked to the second attaching assembly, the linking assembly being rotated together with the first attaching assembly and the second attaching assembly, and the first attaching assembly is engaged with an inner surface of the cover to prevent the first attaching assembly from coming off the one-end wall.

9. The image forming apparatus according to claim 8, wherein a protrusion that engages the first attaching assembly is formed on the inner surface of the cover, and the protrusion is thicker than the cover at a periphery of the protrusion.

10. The image forming apparatus according to claim 8, wherein a fitting part that extends in the longitudinal direction of the conveying member is formed on the first attaching assembly, and a fitting hole to which the fitting part is capable of fitting is formed at the one end of the linking assembly along the longitudinal direction of the conveying member.

11. The image forming apparatus according to claim 10, wherein the fitting part includes an inclined part that is tapered toward the another end at a center of the longitudinal direction.

12. The image forming apparatus according to claim 8, wherein the toner case includes an agitating member that is rotatably attached to the case body, the agitating member including an agitating gear;

a conveying gear connected to the agitating gear is attached to the first attaching assembly; and a coupling to which a rotational driving force is transmitted from a driving source is attached to the second attaching assembly.

13. The image forming apparatus according to claim 8, wherein the second attaching assembly includes a hook, and a linking-assembly-side fitting part is positioned on the another end of the linking assembly, the hook being capable of engaging the fitting part.

14. The image forming apparatus according to claim 8, wherein a boss is formed on the one-end wall, and on the inner surface of the cover, a boss receiver is formed at a position corresponding to the boss.

* * * * *